United States Patent [19]

Acimovic et al.

[11] 4,166,778

[45] Sep. 4, 1979

[54] CYANIDE-FREE ALKALINE ZINC BATHS

[76] Inventors: Simeon Acimovic, Untergasse; Karl H. Lindemann, Schulstrasse 100; Volker G. Kunz, Untergasse 46, all of 6097 Trebur, Fed. Rep. of Germany

[21] Appl. No.: 907,144

[22] Filed: May 17, 1978

[51] Int. Cl.[2] ..... C25D 3/22

[52] U.S. Cl. ..... 204/55 R

[58] Field of Search ..... 204/55 R, 43 Z, 114

[56] References Cited

U.S. PATENT DOCUMENTS

| | | | |
|---|---|---|---|
| 3,655,534 | 4/1972 | Kampe | 204/55 R |
| 3,840,444 | 10/1974 | Koch | 204/55 R |
| 3,871,974 | 3/1975 | Duchene et al. | 204/55 R |
| 3,884,774 | 5/1975 | Kessler | 204/55 Y |
| 3,954,575 | 5/1976 | Yanagida et al. | 204/55 R |
| 3,972,789 | 8/1976 | Eppensteiner et al. | 204/55 Y |
| 3,974,045 | 8/1976 | Takahashi et al. | 204/55 R |
| 4,045,306 | 8/1977 | Senge et al. | 204/55 R |
| 4,046,648 | 9/1977 | Rushmere | 204/55 R |

FOREIGN PATENT DOCUMENTS

| | | | |
|---|---|---|---|
| 1771371 | 7/1972 | Fed. Rep. of Germany . | |
| 2525264 | 12/1976 | Fed. Rep. of Germany . | |
| 2712515 | 11/1977 | Fed. Rep. of Germany | 204/55 R |
| 2264101 | 11/1975 | France | 204/55 R |

*Primary Examiner*—G. L. Kaplan

*Attorney, Agent, or Firm*—Wallenstein, Spangenberg, Hattis & Strampel

[57] ABSTRACT

Cyanide-free alkaline zinc electroplating baths for depositing highly lustrous zinc coatings on steel or iron. The results are attained with alkaline zinc baths containing a reaction product obtained by conversion of substantially equal molar quantities of (a) a reaction product of a nitrogen compound containing at least two nitrogen atoms with an epihalohydrin, or a mixture of such reaction products, with either (b1) a reaction product of an alcohol or a carboxylic acid with an epihalohydrin, or a mixture of such reaction products, and/or (b2) a pyridine compound having from 1 to 3 methyl or ethyl groups and/or 1 to 3 carboxylic groups, or salts of (b1) and (b2). Zinc coated objects produced with the baths can be tempered without adversely affecting the zinc coating.

6 Claims, No Drawings

CYANIDE-FREE ALKALINE ZINC BATHS

The present invention relates to cyanide-free alkaline zinc electroplating baths for depositing lustrous to highly lustrous zinc coatings on steel or iron.

It is known from the prior art to use in alkaline zinc baths, in place of highly toxic alkaline cyanides, less toxic compounds to serve as brighteners and to facilitate zinc deposition. Such compounds are, for example, according to U.S. Pat. No. 3,974,045, polymers prepared by reacting an epihalohydrin with a heterocyclic compound containing one or more nitrogen atoms, such as imidazole, pyrrol, cyclic amines or piperazine, which have been produced in the presence of hexamethylenetetramine and ammonia. Similar brightener additives are described in German Patent Application 2525264, and, in addition, alkylene polyamine reaction products with epihalohydrins for zinc baths are known from German Pat. No. 1,771,371.

However, with these additives, it is frequently necessary to use small quantities of cyanide, otherwise the coatings will lack the required luster, throwing power and resistance to abrasion. It has been found, moreover, especially with baths containing reaction products of epichlorohydrin with heterocyclic nitrogen compounds such as imidazole, 1,2,4-triazole or their derivatives, that blisters form of a size of more than about 10 microns and rupture. The brittleness of the coatings is of particularly great importance if electroplated objects have to be subsequently tempered whereby heating at temperatures to 150° to about 180° C. may occur.

It has been discovered that zinc coatings of up to 40 microns thick which are highly lustrous and can be tempered without any problem are obtainable from alkaline zinc baths, free from cyanide, which contain a reaction product which has been obtained by conversion of equal molar quantities of (a) the reaction product of a nitrogen compound containing at least two reactive nitrogen atoms with an epihalohydrin, or of mixtures of such reaction products, at a mole ratio of 1:1 with either (b1) the reaction product of an alcohol or a caboxylic acid with an epihalohydrin, or of mixtures of such reaction products, at a mole ratio of 1:1 or (b2) a pyridine compound which contains 1 to 3 methyl or ethyl groups and/or 1 to 3 carboxylic groups as substituents, or both (b1) and (b2), or their salts.

The reaction product (a) preferably is the product of the reaction of one or several nitrogen compounds containing for each nitrogen atom 1 to 5 carbon atoms, with epichlorohydrin or epibromohydrin, and the reaction product (b1) is one which has been obtained by conversion of one or several multivalent alcohols containing for each oxygen atom 1 to 5 carbon atoms, with epichlorohydrin or epibromohydrin. Examples of compound (b2) are pyridine, the alpha, beta or gamma methyl and/or ethyl pyridines and the corresponding mono, di, and tricarboxylic acids of pyridine and the methyl and/or ethyl pyridines.

Particularly preferred for the production of the reaction product (a) are imidazole, pyrazole, 1,2,3 or 1, 2, 4-triazole, tetrazole, pyridazine, pyrimidine, pyrazine, 1,2,3-oxadiazole, 1, 2,4- or 1, 3,4-thiadiazole or their derivatives with one or two substituents from the group of methyl, ethyl, phenyl-amino groups, or, if applicable, with an added benzol nucleus, whereby tetraethylenepentamine or polyethylene imine or several of these compounds are converted with epichlorohydrin, and as the reaction product (b1) one of glycol, glycerine, butane diol, butene diol, propionic acid, chloropropionic acid or trichloro acetic acid or several of these compounds with epichlorohydrin are used. Picoline, nicotinic or isonicotinic acid and/or their alkaline salts are preferred as compound (b2).

The zinc bath according to the invention contains quantities of the product obtained by reaction of the reaction product (a) with the reaction product (b1) and/or by reaction of the reaction product (a) with a pyridine compound (b2), ranging from 0.1 to 100 grams/liter, preferably 0.5 to 20 grams/liter, with a quantity from 2.5 to 5 grams/liter being especially preferred. Additional additives to the bath according to the invention include, besides the zinc compound which usually is dissolved in the form of zinc oxide with potassium or sodium hydroxide in aqueous solution and the reaction product according to the invention, the usually used additives such as aldehydes and/or ketones, particularly aromatic aldehydes, like vanillin, anisic aldehyde, veratrum aldehyde or benzaldehyde, and if applicable also sulfur compounds, like thiourea, polyvinyl alcohol, polyvinyl pyrolidone and if applicable also other customary amino compounds, the like of which are known from the state of the art.

The concentrations of zinc, alkali hydroxide and the other additives used in the baths are within the usual range, generally from 4 to 20 grams/liter, more specifically 7 to 15 grams/liter of zinc and as much alkali hydroxide as is required to attain a pH value of 12, which corresponds approximately to a quantity of 80 to 160 grams/liter, depending on the other components present in the bath. The aromatic aldehydes and/or ketones, and the other additives used, are pesent in quantities ranging from 0.05 to 1 gram/liter, usually from 0.1 to 0.2 grams/liter.

The zinc bath according to the invention is particularly suitable for the production of thick zinc layers on iron or steel which are temperature-resistant up to approximately 220° C. (=428° F.). The bath is very stable, and, surprisingly, becomes even more stable after it has been standing for a length of time. Thus, it is very useful for producing coatings on objects of irregular configuration whereby with the aid of varying current density thicker or thinner layers are formed on the same object. The current densities range from 0.1 to 6 amperes/square decimeter, but depend to a large extent on the concentration of the components of the bath. These concentrations can be increased further, but this results in lower current yields.

The invention will be more fully understood by reference to the following detailed examples.

EXAMPLE I

A zinc bath was produced from the following components:

Zinc oxide =7 to 15 grams/liter of zinc
Sodium hydroxide =80 to 160 grams/liter
Conversion product from identical mole quantities of
(a) the reaction product of epichlorohydrin with tetraethylenepentamine at a mole ratio of 1:1 with
(b) the reaction product of epichlorohydrin and glycerine at a mole ratio of 1:1=8 to 12 cc/liter
Vanillin: 0.1 grams/liter
Anisic aldehyde: 0.1 grams/liter
Polyvinyl alcohol: 0.1 grams/liter
Thiourea: 0.2 to 0.5 grams/liter The bath was used for electroplating iron pipes at a current density of 0.2 to 8 amperes/dm$^2$. Coatings with a thickness of 40 to 45 microns were obtained which were highly lustrous, which did not become brittle when tempered to 180° C. but adhered firmly.

EXAMPLE II

A zinc bath was produced from the following components:

Zinc oxide =7 to 15 grams/liter of zinc
Sodium hydroxide =80 to 160 grams/liter.
Conversion product from identical mole quantities of
(a) the reaction product of epichlorohydrin with chloropropionic acid at a mole ratio of 1:1 with
(b) the reaction product of epichlorohydrin and imidazole at a mole ratio of 1:1=8 to 12 cc/liter
Veratrum aldehyde: 0.2 grams/liter
Polyvinyl alcohol: 0.1 grams/liter
Thiourea: 0.2 to 0.5 grams/liter With the bath, zinc coatings were produced on iron pipes at a current density from 0.1 to 6 amperes/dm$^2$ with a thickness exceeding 30 microns which did not burst or peel off when tempered to 180° C.

EXAMPLE III

A zinc bath was produced from the following components:

Zinc oxide =7 to 15 grams/liter calculated as zinc
Sodium hydroxide =80 to 160 grams/liter
Conversion product from identical mole quantities of
(a) the reaction product of epichlorohydrin and 1,2,3-triazole at a mole ratio of 1:1 with
(b) the reaction product of epichlorohydrin and butene diol at a mole ratio of 1:1=8 to 12 cc/liter
Vanillin: 0.2 grams/liter
Polyvinyl alcohol: 0.1 grams/liter
Thiourea: 0.2 to 0.5 grams/liter With this bath a zinc coating on iron was produced at a temperature range from 18° to 35° C. at a current density of 0.2 to 5 amp/dm$^2$, with a thickness of 40 microns, which had highly lustrous properties and which did not burst or peel off at temperatures from 170° to 180° C. The bath did not change its stability over several months.

EXAMPLE IV

A zinc bath was produced from the following components:

Zinc oxide =7 to 15 grams/liter as zinc
Sodium hydroxide =80 to 160 grams/liter
Conversion product from identical mole quantities of
(a) the reaction product of epichlorohydrin and polyethylene imine at the mole ratio of 1:1 with
(b) the reaction product of epichlorohydrin and glycerine at the mole ratio of 1:1=8 to 12 ml/liter
Anisic aldehyde: 0.2 grams/liter
Polyvinyl alcohol: 0.1 grams/liter
Thiourea: 0.2 to 0.5 grams/liter Zinc coatings of from 30 to 50 microns thick were produced with the zinc bath on iron pipes which were highly lustrous and did not burst or peel off upon tempering to 150° to 180° C. The bath maintained its stability for several months.

EXAMPLE V

A zinc bath was produced from the following components:

Zinc oxide =7 to 15 grams/liter as zinc
Sodium hydroxide =80 to 160 grams/liter
Conversion product from identical mole quantities of
(a) imidazole and epibromohydrin at a mole ratio of 1:1 with
(b) the sodium salt of nicotinic acid =5 to 8 cc/liter
Anisic aldehyde: 0.1 grams/liter
Polyvinyl alcohol: 0.1 grams/liter
Thiourea: 0.2 to 0.5 grams/liter Zinc layers of 30 to 50 microns thick were deposited on iron pipes at a temperature of 18° to 30° C. and a current density of 0.1 to 5 amp/dm$^2$, which were lustrous to highly lustrous and did not burst or peel off when tempered to 150° to 180° C. The bath maintained its stability in storage over several months.

We claim:

1. An alkaline zinc electroplating bath, free from cyanide, containing a zinc salt, an alkaline compound, and a reaction product which has been obtained by reaction of equal molar quantities of
   (a) the reaction product of a nitrogen compound containing at least two reactive nitrogen atoms with an epihalohydrin, or a mixture of such reaction products, at a mole ratio of 1:1 with either
   (b1) the reaction product of an alcohol or a carboxylic acid with an epihalohydrin, or a mixture of such reaction products, at a mole ratio of 1:1, or
   (b2) a pyridine compound which contains 1 to 3 methyl or ethyl groups and/or 1 to 3 carboxylic groups as substituents, or both (b1) and (b2), or their salts.

2. An alkaline zinc electroplating bath, free of cyanide, as claimed in claim 1, characterized in that it contains a reaction product which has been obtained by reaction of equal molar quantities of
   (a) the reaction product of one or more nitrogen compounds containing for each nitrogen atom 1 to 5 C atoms, with epichlorohydrin or epibromohydrin with
   (b1) the reaction product of a polyvalent alcohol, or several polyvalent alcohols, containing for each oxygen atom 1 to 5 C atoms, with epichlorohydrin or epibromohydrin.

3. An alkaline zinc electroplating bath, free of cyanide, as claimed in claims 1 or 2, characterized in that it contains as the epihalohydrin reaction product a compound obtained by reaction of equal molar quantities of
   (a) the reaction product of imidazole, pyrazole, a 1,2,3- or 1,2,4 triazole, tetrazole, pyridazine, pyrimidine, pyrazine, 1,2,3-oxadiazole, 1,2,4 or 1,3,4 thiadiazole and/or their derivatives with 1 or 2 substituents from the group of methyl, ethyl, phenylamino groups, or with an added benzol nucleus, tetraethylenepentamine or polyethylene imine or a mixture of these compounds with epichlorohydrin and either
   (b1) the reaction product of glycol, glycerine, butane diol, butene diol, propionic acid, chloropropionic acid or trichloroacetic acid or a mixture of these compounds with epichlorohydrin or of
   (b2) alpha, beta or gamma pyridinic carboxylic acid, or both (b1) and (b2).

4. An alkaline zinc electroplating bath, free of cyanide, as claimed in claims 1 or 2 characterized in that the epihalohydrin reaction product is present in an amount ranging from 0.1 to 100 grams/liter.

5. An alkaline zinc electroplating bath, free of cyanide, as claimed in claim 4, characterized by containing the epihalohydrin reaction product in quantities from 0.5 to 20 grams/liter.

6. An alkaline zinc electroplating bath, free of cyanide, as claimed in claims 1 or 2 characterized by containing as additional additives an aldehyde, a polyalcohol, or thiourea or a mixture thereof.

* * * * *